United States Patent [19]

Salloum

[11] Patent Number: 4,850,784

[45] Date of Patent: Jul. 25, 1989

[54] CROSS FLOW MULTILEVEL PARKING SYSTEM

[76] Inventor: Charles R. Salloum, 12 Ellis St. #307, San Francisco, Calif. 94102, Renee Milano, Executrix

[21] Appl. No.: 144,961

[22] Filed: Jan. 19, 1988

[51] Int. Cl.[4] ..... E04H 6/06

[52] U.S. Cl. ..... 414/263; 414/261; 414/252

[58] Field of Search ..... 414/227, 232, 234, 233, 414/239, 240, 241, 242, 244, 252, 253, 257, 259, 261, 262, 263, 266, 271, 268, 285

[56] References Cited

U.S. PATENT DOCUMENTS

| | | | |
|---|---|---|---|
| 1,465,135 | 8/1923 | Kehr | 414/263 X |
| 2,691,448 | 10/1954 | Lontz | 414/263 X |
| 3,136,267 | 6/1964 | Kness | 414/261 X |
| 3,382,990 | 5/1968 | Salloum | 414/261 X |
| 3,414,141 | 12/1968 | Rougemont | 414/252 X |
| 3,419,161 | 12/1968 | Hagel | 414/263 X |
| 3,613,909 | 10/1971 | Salloum | 414/263 X |
| 3,672,517 | 6/1972 | Salloum | 414/263 X |
| 3,845,717 | 11/1974 | Alimanestianu | 414/252 X |

FOREIGN PATENT DOCUMENTS

| | | | |
|---|---|---|---|
| 991691 | 5/1965 | United Kingdom | 414/252 |

*Primary Examiner*—Frank E. Werner
*Attorney, Agent, or Firm*—Alvin E. Hendricson

[57] ABSTRACT

In an automated multilevel rotary parking system double flow through vehicle paths including endless conveyors and elevators together with rotary parking platforms maximize vehicle handling capabilities. Vehicle flow paths are particularly arranged to facilitate vehicle movement in a rapid and orderly manner.

5 Claims, 3 Drawing Sheets

CROSS FLOW MULTILEVEL PARKING SYSTEM

FIELD OF INVENTION

Rotary parking systems are designed to maximize vehicle storage capability per unit of area required for the system and to minimize the time required to store or park a vehicle and to retrieve a vehicle from the system. In this respect reference is made to my copending U.S. Pat. Nos. 3,378,151, 3,382,990 and 3,613,909 and references cited therein for background in the development of this type of system.

Large volume rotary parking systems most efficiently incorporate both inner and outer arrays of elevators for moving vehicles between inner and outer rotary parking platforms at vertically stacked parking level and obviating the necessity of moving vehicles across parking platforms for access to other parking platforms. In such large scale systems difficulties may be encountered in the layout of entrance and exit driveways or the like leading to an from the system. The present invention is directed to a system having particularly located entrance and exit stations with flow-through paths within the system to obviate the above noted difficulties.

SUMMARY OF INVENTION

A multilevel parking system has three levels for entrance and exit with particular arrangements thereof providing for rapid and efficient movement of vehicles or the like into and out of the system. With regard to the parking and/or storage of vehicles within the system and movement thereof between entrance and exit stations, reference is made to my prior copending U.S. patent application Ser. No. 849,183 entitled "Automated Vehicle Parking System" and now abandoned. The improvement hereof relates to the arrangement of entrances and exits wherein an inner core of elevators serving inner parking platforms at successive parking levels are entered and exited from second and third levels and an outer array of elevators serving outer parking platforms at such parking levels are entered and exited from a first and second level. These entrance and exit levels may be located as desired with respect to ground level with a preferable arraignement having the second level at ground level. Thus a preferred embodiment has both entrances at ground level with the exit for the outer array of elevators being by ramp from a basement level and the exit from the inner array of elevators being by ramp from the second floor of the system.

Systems of this type having both inner and outer arrays of elevators normally suffer from the limitations that one of the arrays require entrance and exit stations to be directly above one another so that exterior ramps interfere with each other. The present invention provides a flow through system wherein vehicles destined for either array of elevators enter one side of the building housing the system and leave the opposite side of the building. This then obviates the overcrowding of one side of the system often encountered in prior art systems while ensuring a free flow of vehicles to and from each array of elevators to maximize entry and exit rate as is required for high volume handling systems.

A preferred embodiment hereof provides entrance stations for both inner and outer arrays of elevators at a single level in orthagonal arrangement. Exit from the inner array of elevators is located above the entrance level therefore in an opposite direction and exit from the outer array of elevators is located below the entrance level therefore also in an opposite direction therefrom. In this manner interference between flow paths to and from the separate arrays of elevators are precluded and an improved traffic flow is attained.

BRIEF DESCRIPTION OF THE DRAWINGS

The present invention is illustrated with respect to particular preferred embodiment of the invention in the accompanying drawings, wherein.

DESCRIPTION OF PREFERRED EMBODIMENT

The present invention is particularly directed to the improvement in entry and exit for multilevel rotary parking platform systems employing both inner and outer array is elevators for maximizing the rate at which vehicle that may be moved into and out of the system. The following description of referenced to vehicle parking although it will be appreciated from the description that containers or the like may be handled in substantially the same manner by the present invention.

Figure 1:
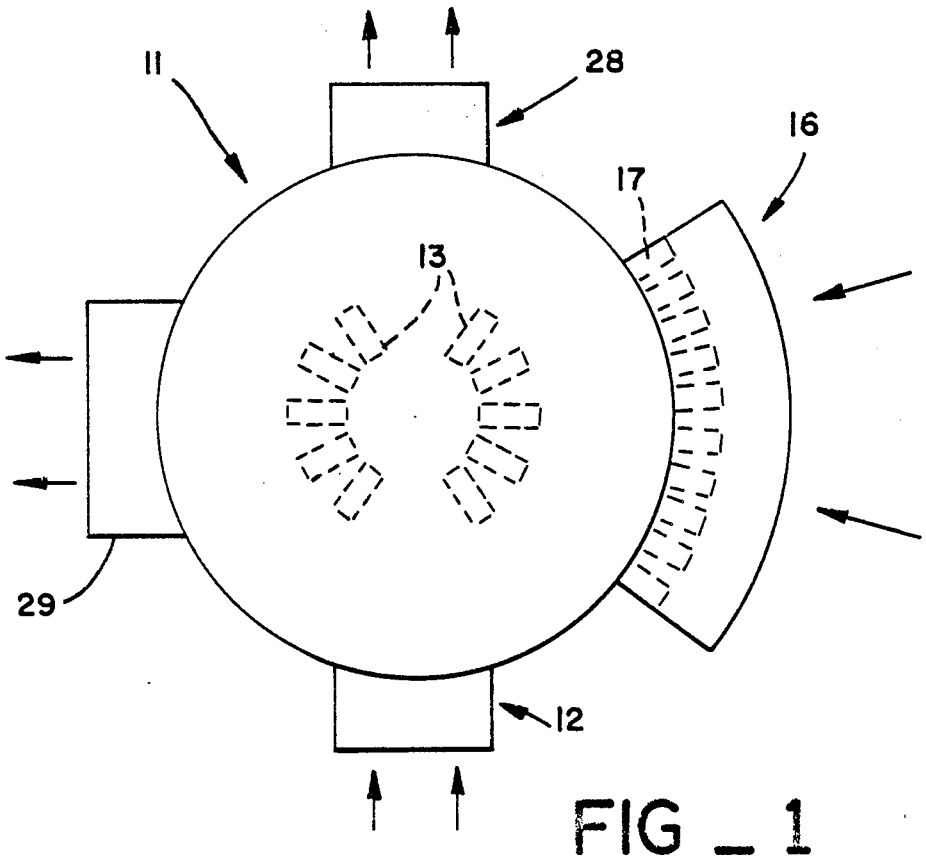
FIG. 1 is a schematic plan view of the building of FIG. 2 and indicating traffic flow into and out of the system.
Figure 2:
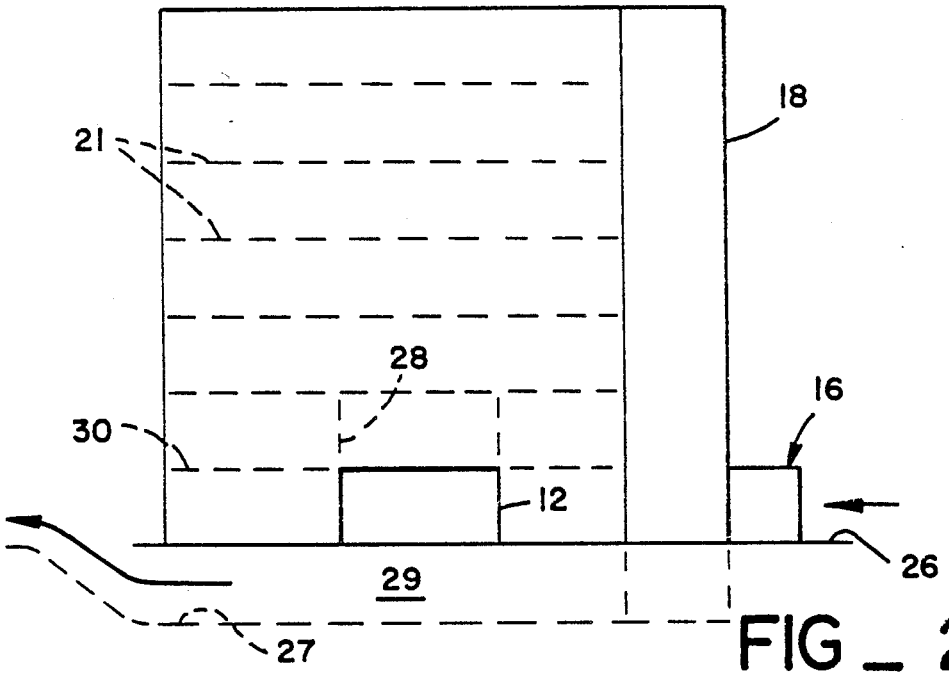
FIG. 2 is a schematic side elevational illustration of a parking system building in accordance herewith and indicating ingress and egress.

Referring now to FIG. 1 and 2 of the drawings, it will be seen to be shown a central building 11 that may have a generally circular configuration and having a height sufficient to accommodate a plurality of vertically spaced parking levels. This building is provided with an entry 12 leading to an inner core of elevators 13 and a second entry 16 leading to an outer array of elevators 17 disposed in a building extension 18. It will, of course, be appreciated that the exterior configuration of the building and the extension 18 may be varied to suit particular applications and the illustrations thereof is intended to only define a minimum building requirement. Square, rectangular, or other building configurations are possible, with the additional space provided thereby being available for shops, offices, hotel rooms, and a wide variety of additional applications.

Figure 4:
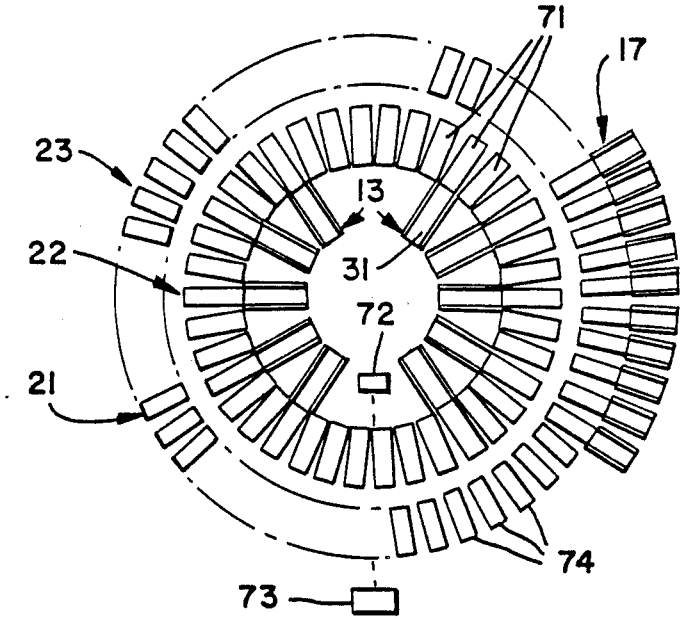
FIG. 4 is a schematic plan view of a parking level of the system hereof.
Figure 5:
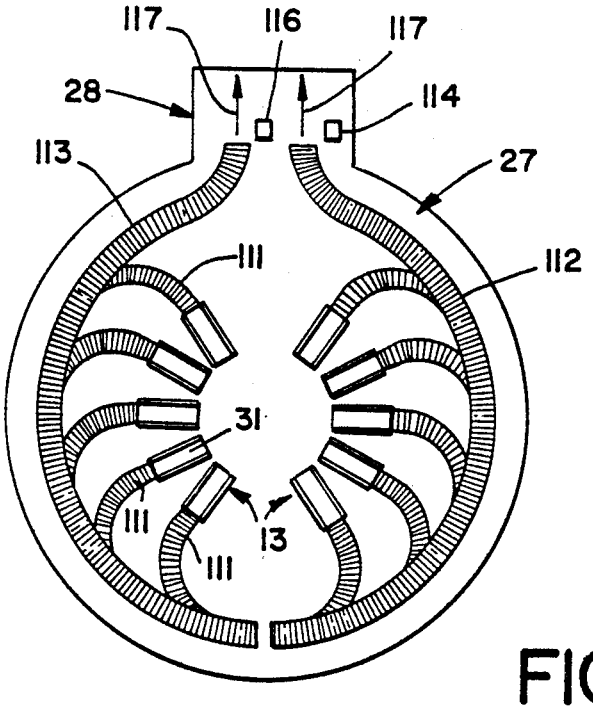
FIG. 5 is a schematic plan view of an upper exit level of the system hereof.

Within the central building 11 there are provided a plurality of vertically spaced parking or storage levels as indicated, for example, at 21 of FIG. 4. In the illustrated embodiment of the present invention, each parking level includes an inner annular parking "platform" 22 and surrounding outer annular parking or storage "platform" 23 surrounding the inner platform. The construction of these platforms may be varied according to the particular application of the present invention, and it is also noted the so called platforms may also be formed as oval instead of circles by appropriate modification of the construction thereof. The inner platform 22 is serviced by the central core of elevators 13 and the outer platform 23 is serviced by the outer array of elevators 17. Substantially any desired number of vertically spaced parking levels 21 may be provided in accordance with the present invention, it being noted that it is preferable to provide additional elevators to service a substantially increased number of vertically spaced parking levels in order to expediate the rate of entry and removal of vehicles or the like to and from the present system.

Figure 3:
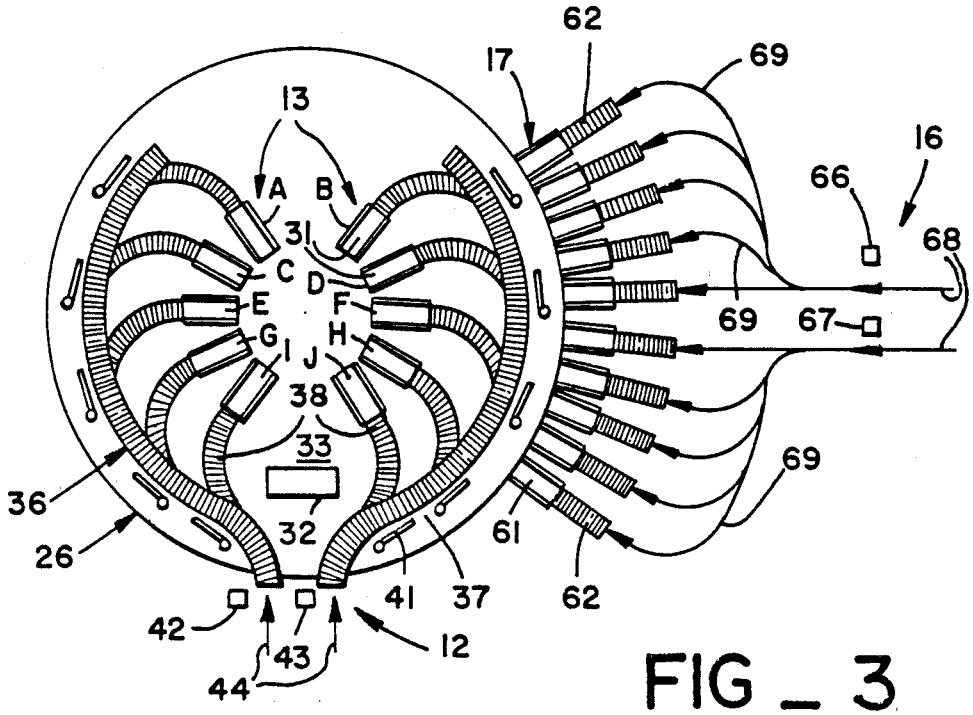
FIG. 3 is a schematic plan view of an entrance level of the system hereof.

It is noted that the entry 12 for the inner array of elevators 13 and entry 16 for the outer array of elevators 17 are both provided at the same level which is preferably ground level of the system. This is indicated in FIG. 2 and it will be further noted that these entries are disposed orthogonally, ie. at right angles to each other so that entries may be provided from separate streets, for example. In accordance with the present invention, considering now the entrance level 26 illustrated in FIG. 3, it will be seen that the central core of elevators 13 are provided in a circular array with the elevator opening radially outward thereof. Each of these elevators contain controllably driven endless conveyor belts 31 on the floor thereof and these conveyor belts are adapted to reverse direction and are controlled by a central computer 32 that may be disposed at an entry station 33 whereat an operator may operate the present system for automatically entering and removing vehicles from the system. A toy system of the present invention preferably includes a manual control board in place of or in conjunction with the computer 32 so that a child, for example, may select the parking stall for a vehicle and move the vehicle into and out of same. At the entry level 26, there are provided a pair of primary conveyor belts 36 and 37 disposed in semicircular configuration radially outward of the core of elevators 13 with reversed curved "ends" disposed at the entry 12. In addition, there are provided a plurality of curved secondary conveyors 38 individually extending from the conveyor 36 and 37 to the entrances of the individual elevators of the core of elevators 13. These elevators 13 are individually identified in the drawings by the letters A–J employed hereinafater with the generic numeral 13 as an identification of individual elevators. There are also provided pivotably mounted control arms 41 disposed about the exterior conveyors 36 and 37 radially outward from the 1 of the inner curved conveyors 38 with the outer control, again as illustrated in FIG. 3.

There is further provided at the entrance levels 26 a pair of ticket dispensers 42 and 43 disposed adjacent the outer ends of the conveyors 36 and 37 at the entry 12. Vehicles are directed by appropriate means to enter the entry 12 of the present system onto the ends of the conveyors 36 and 37, as indicated by the arrows 44 in FIG. 3.

Considering further the conveyors of the present invention, it is noted that same may be generally conventional and same are in fact commercially available. The conveyors 36 and 37 may be formed as endless belts driven by conventional means over rollers or alternatively may comprise driven rollers, some times termed live roller conveyors. The pivotally mounted control arms or diverters 51 and the conveyors themselves may be driven by electric motors, for example controlled by the computer 32. The inner or secondary conveyors are separately driven by separate motors controlled by the computer 32 and similarly the conveyors 31 in the elevators 13 are separately driven and controlled by the computer 32. With regard to details of the foregoing reference is made to my above-noted co-pending patent application.

Upon return of a vehicle to an exit level 30, the conveyor 31 in an elevator 13 is computer actuated to move the vehicle onto a conveyor 111 which is motor driven in the manner of the conveyors 38 at the entrance level to move the vehicle outwardly onto one of a pair semicircular conveyors 112 and 113 disposed about the core of elevators 13. It is particularly noted that the conveyors 111 are curved from these elevators in a direction away from the exit ends of the outer conveyors 112 and 113. The purpose of the foregoing will become apparent when it is considered that the vehicle entered the elevator faced radially inward at the entrance, and after storage and removal from storage onto the elevator is still in this same orientation. Thus as the vehicle is deposited at the exit level 30 it will be drawn rearwardly out of the elevator and the conveyor 111 will then move the vehicle rearwardly onto the outer conveyor 112 or 113 so that the vehicle is deposited thereon facing toward the exit 28. Actuation of the outer conveyor will thus move the vehicle about the core of elevators to the exit 28 with the vehicle facing outwardly so that the vehicle is available to be driven forwardly out the system. The outer conveyors 112 and 113 are briefly operated in a reverse direction away from the exit 28 during acceptance of a vehicle from an inner conveyor 111 to facilitate transfer of the vehicle from one conveyor to another and proper alignment of the vehicle on the outer conveyor.

The outer conveyors 112 and 113 lead to the exit 28 whereat there may be provided exit control means including, for example, an operator accepting the required parking fee and inputting appropriate information to the central computer for retrieval of a particular vehicle. These exit control means are schematically illustrated at 114 and 116 with arrows 117 then indicating a ramp or the like along which the vehicle may be driven from the system onto street level.

Retrieval of vehicles from the outer ring 23 of parking stalls 74 at any parking level of the present system is accomplished in a manner similar to that described above with respect to the inner parking platform 22. More specifically the outer platform 23 is rotated or angularly indexed under control of the computer 32, as directed by an exit operator, to align a desired parking stall 74 with a desired outer elevator 17. The associated ejector is then automatically operated to remove the vehicle from the stall 74 into the aligned elevator 17 where it is drawn into the elevator by the conveyor 61 therein. The elevator 17 is then moved to the lower exit level 27 and the elevator conveyor 61 is then operated to move the vehicle inwardly of the elevator onto one of a plurality of conveyors 122.

Figure 6:
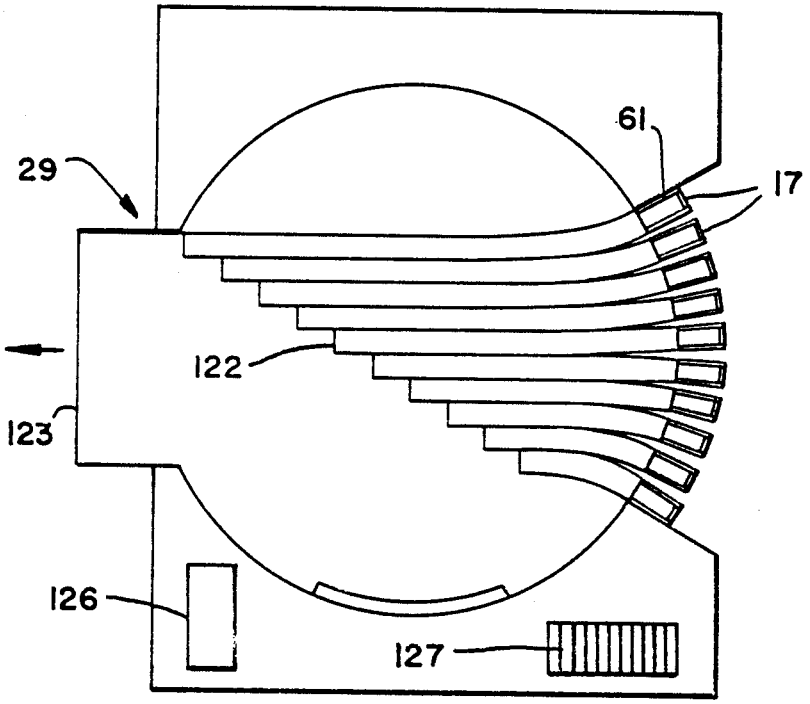
FIG. 6 is a schematic plan view of a lower exit level of the present invention.

Considering further the exit 29 for the outer array of elevators 17 and referring to FIG. 6 of the drawings, it will be seen that vehicles are moved inwardly of the system from the elevator 17. Conveyors 122 extend inwardly from each of the elevators toward the exit 29. These conveyors 122 extend an increasing distance from the first to last with the difference in length being at least equal to the length of an automobile or vehicle in order to facilitate a driver or passengers entering the vehicle when it is delivered at the exit level by an appropriate elevator and associated conveyor. This arrangement is clearly illustrated in FIG. 6 wherein there is also shown an exit station or cashier station 126 whereat the driver presents his parking ticket and pays for the parking. This station 126 is computer operated or computer assisted so that a parking ticket or the information thereon may be entered into the computer system for automatic control over the retrieval of the vehicle identified by such ticket. The ticket preferably has certain information printed thereon such as parking level and parking stall in which the vehicle has been stored together with at least the date and time of entry of the vehicle into the system. An escalator 127, for example, may be provided to assist patrons in reaching the exit level 27 from ground level. It will be seen that the exit level may include extra space beyond that required for movement of vehicles and this may be employed for a wide variety of purposes such restrooms, stores, equipment rooms, cafeterias, lounges, and the like for the convenience of persons employing the parking system and for operation of the present system. In particular it is noted that auxiliary electric generators are provided, as in an equipment room, for supplying power to the system hereof in case of a power failure.

A person wishing to retrieve his vehicle that has been stored on an outer rotary parking platform serviced by the outer array of elevators 17 will present his ticket to the cashier at station 126 and after paying the parking fee will receive a ticket identifying the conveyor 122 upon which his vehicle will appear for retrieal by the driver of the vehicle. The driver and passengers may enjoy the ambiance provided upon the exit level and when the vehicle has been retrieved from the system and moved by a conveyor 122 to the end thereof, the driver will be appraised of same by audio or visual means so that he and any passengers may then walk to the vehicle, enter same and drive out through the exit ramp 123. It is noted in this respect that all vehicles stored in the present system are locked at all times, so that only the proper driver can enter his vehicle with his key and then start up the vehicle to drive away. It will be appreciated that the present invention incorporating an exterior bank of elevators, is similar in some aspect to my prior parking systems, however, particular advantage lies in the arrangement of the exit level hereof, and particularly the staggered conveyor arrangement for ease of entry into the vehicles at the exit level 27.

It will be seen from the foregoing that the present invention provides a particular improved arrangement of entrance and exit locations for the inner and outer arrays of elevators employed in the system. Entrance and exiting of the system via the inner array of elevators 13 is accomplished by movement of vehicles inwardly of the system and thence outwardly therefrom in the same direction. Similarly, vehicles entering the system for handling by the outer array of elevators 17 subsequently move out the system in the same direction as they entered. There is thus herein provided a flow-through arrangement which is accomplished by employing three levels for entrance and exit and wherein the intermediate level is employed for entrance only, and the other two levels are employed for exit for separate banks or arrays of elevators. The flow of vehicles employing the central array of elevators is orthongonal to or ninety degrees (90°) to flow of vehicles employing the outer array of elevators. This is highly advantageous in precluding possible disruption of flow paths or interference between flow paths that would tend to slow down the flow of vehicles into and out of the system hereof.

From the foregoing, it will be seen that the present invention provides a parking system capable of rapidly handling a large number of entering and exiting vehicles in a truly automated fashion. It will be apparent to those skilled in the art that numerous modifications and variations of the present invention may be made within the spirit and scope of the invention and thus it is not intended to limit the invention to the details of illustration or terms of description.

What is claimed is:

1. A multilevel automated rotary parking system having vertically spaced parking levels with inner and outer rotary parking platforms at each level defining a generally circular parking unit with an inner array of elevators servicing the inner parking platform and an outer array of elevators servicing the outer parking platform at one side thereof and comprising an entrance level having a first entrance station with vehicle paths leading therefrom to the elevators of said inner array of elevators and a second entrance station disposed substantially ninety degrees from said first entrance station about the circumference of said circular parking unit and having vehicle paths leading to the elevators of said outer array of elevators, a first exit level disposed below said entrance level and having an exit station with vehicle paths extending from said outer array of elevators diametrically across said level of said circular parking unit whereby vehicles moved by said outer array of elevators enter one side of the system and exit from the opposite side thereof, and a second exit level disposed above said entrance level and having a second exit station located on the opposite side of the system from said first entrance stations with vehicle paths extending from said inner array of elevators to said second exit station whereby vehicles moved by said inner array of elevators enter one side of said system and leave the opposite side of the system, with vehicles moved by said outer array of elevators moving into and out of this system in a direction that is ortogonal to the direction of movement of vehicles into and out of the system employing the inner arry of elevators.

2. The system of claim 1 further defined by said outer array of elevators extending from said first exit level to said entrance level and said parking levels, and said inner array of elevators extending from said entrance level to said parking level whereby said orthogonal vehicle directions of movement are provided without interference therebetween for facilitating rapid movement of vehicles into and out of the system.

3. The system of claim 1 further defined by said entrance level having conveyors extending from said first entrance station to said inner array of elevators as said paths therebetween and said second primary conveyors extending from said first entrance station about opposite sides of said inner array of elevators and secondary conveyors extending one from each elevator of said inner array of elevators to an adjacent primary conveyor for rapid loading of said inner array of elevators

4. The system of claim 1 further defined by the vehicles paths on said second exit level comprising at least one primary conveyor extending from the front of said inner array of elevators to said second exit station, a plurality of secondary conveyors extending one from each elevator of said inner array of elevators to said primary conveyor in a direction away form said second exit station, and means first moving said primary conveyor away from said second exit station as said secondary conveyors move vehicles thereon and then moving said primary conveyor toward said second exit station to transfer vehicles thereto whereby said vehicles are reversed in direction to point forwardly out of said second exit station.

5. The system of claim 1 further defined by said entrance level being disposed at ground level of the system, said first exit level being disposed at basement level of the said system with a vehicle ramp extending from said first exit station up to ground level, and said second exit level being provided as a second floor of said system with a vehicle ramp extending downward from said second exit station to ground level.

* * * * *